US006666573B2

(12) United States Patent
Grassi

(10) Patent No.: US 6,666,573 B2
(45) Date of Patent: Dec. 23, 2003

(54) PORTABLE MIXING/DELIVERY APPARATUS FOR PRE-BLENDED GRANULAR MIXTURES

(76) Inventor: Frank Grassi, 1793 Manchester Blvd., Grosse Pointe Woods, MI (US) 48236

( * ) Notice: Subject to any disclaimer, the term of this patent is extended or adjusted under 35 U.S.C. 154(b) by 95 days.

(21) Appl. No.: 09/982,611

(22) Filed: Oct. 18, 2001

(65) Prior Publication Data

US 2003/0076737 A1 Apr. 24, 2003

(51) Int. Cl.[7] ..... B01F 15/02

(52) U.S. Cl. ..... 366/26; 366/41; 366/50; 366/183.1; 366/150.1

(58) Field of Search ..... 366/26, 38, 42, 366/41, 45, 46, 47, 48, 50, 183.1, 150.1, 318; 141/314; 222/413

(56) References Cited

U.S. PATENT DOCUMENTS

| | | | | | |
|---|---|---|---|---|---|
| 553,752 | A | * | 1/1896 | Goff | 209/244 |
| 1,753,716 | A | * | 4/1930 | Owen | 366/38 |
| 1,829,479 | A | * | 10/1931 | Elkins | 366/50 |
| 2,320,509 | A | * | 6/1943 | Cook | 366/38 |
| 2,606,645 | A | * | 8/1952 | Heine | 222/413 |
| 4,075,711 | A | * | 2/1978 | Hall | 366/26 |
| 4,449,826 | A | * | 5/1984 | Mathis et al. | 366/42 |
| 4,527,716 | A | * | 7/1985 | Haas et al. | 222/83.5 |
| 4,798,510 | A | * | 1/1989 | Lazenby | 414/607 |
| 4,953,752 | A | * | 9/1990 | Tousignant et al. | 222/413 |
| 4,956,821 | A | * | 9/1990 | Fenelon | 366/26 |
| 4,966,311 | A | * | 10/1990 | Taylor | 222/105 |
| 5,184,754 | A | * | 2/1993 | Hansen | 222/413 |
| 5,184,759 | A | * | 2/1993 | Gill et al. | 222/181.3 |
| 5,333,757 | A | * | 8/1994 | Volk et al. | 222/181.3 |
| 5,415,323 | A | * | 5/1995 | Fenelon | 222/1 |
| 5,494,351 | A | * | 2/1996 | Hakasalo | 366/318 |
| 5,642,939 | A | * | 7/1997 | Comardo | 366/132 |
| 5,848,871 | A | * | 12/1998 | Thiessen | 414/607 |
| 6,112,955 | A | * | 9/2000 | Lang | 222/413 |
| 6,123,445 | A | * | 9/2000 | Grassi | 366/50 |
| 6,206,249 | B1 | * | 3/2001 | Lang et al. | 222/412 |
| 6,213,315 | B1 | * | 4/2001 | Forney et al. | 211/85.15 |
| 6,250,506 | B1 | * | 6/2001 | Geiger et al. | 222/413 |
| 6,290,098 | B1 | * | 9/2001 | Sterner et al. | 222/105 |

* cited by examiner

*Primary Examiner*—Tony G. Soohoo
(74) *Attorney, Agent, or Firm*—Emrich & Dithmar

(57) ABSTRACT

A portable mixing/delivery apparatus mixes dry pre-blended materials, such as homogeneous cementitious combinations of dry sand, cement, Lime, color pigments, etc., packaged in large bulk bags for use at a remote construction site. The bulk bag is lifted by a removable rack having plural lift eyes and the combination is positioned over a height adjustable frame. The granular material is then discharged into a continuous mixer having a dynamic input mixing stage, an output dry-to-wet mixing stage, and a transition stage therebetween. The entire assembly (bulk bag, frame and continuous mixer) is portable and can be lifted such as by a forklift to the height of a masonry scaffold for dispensing the mixed, wet granular material directly to the point of use. The apparatus allows the continuous mixer and its discharge tube to rotate to facilitate dispensing of the material directly to the point of use.

20 Claims, 6 Drawing Sheets

PORTABLE MIXING/DELIVERY APPARATUS FOR PRE-BLENDED GRANULAR MIXTURES

FIELD OF THE INVENTION

This invention relates generally to apparatus for mixing and dispensing granular materials and is particularly directed to portable apparatus for mixing, wetting and discharging pre-blended granular materials, such as cementitious-type materials, at a remote construction site.

BACKGROUND OF THE INVENTION

The products to which this invention applies can vary from concrete mixes, including bricklaying mortars and grouts. The traditional method of producing mortar or grout at a masonry job site is to count shovelfuls from a pile of sand, add mortar/cement by breaking open a 90 lb. paper bag, followed by adding water with a pail to a batch mixer. This method is still used on 80% of masonry construction jobs. Basic drawbacks of this approach are that it is labor-intensive and that the mix composition varies depending on type or condition of the sand, which when damp can increase the mixture volume by as much as 30%. Since sand is the predominant ingredient, variation in the mixture composition is inherent in the method of counting shovelfuls and cannot be precisely controlled. Mortar bond-strength, compressive strength, color and other factors of the mortar also vary. This can cause many serious problems that sometimes lead to removal of defective material, which, of course, is usually very costly.

Another method of producing mortar that addresses some of the aforementioned problems is to dry sand at a remote location and pre-blend the components, i.e., sand, mortar cement, lime and even color additives, and package the blend in bulk bags (2000 to 4000 lb.) and deliver the bags to a job site. In one approach, the bulk bags are individually placed in a silo that contains up to six bags of material. The contents of the silo is then dispensed into a batch-type mixer wherein water is added. This approach can be used to produce both grout and mortar, but requires at least two silos and two batch mixers (one for each type of material). The silo is portable only when empty to facilitate set-up delivery to a job-site. At the job site, it is set up as a fixed mixing operation remotely located from where the masonry brick laying operation is taking place. The mixing cycle is also labor intensive, requiring two workers, a forklift operator and a laborer to supply the masonry laying crew with mortar or grout.

This silo mixing operation begins with the forklift operator exchanging a full tub with an empty tub which the mixed contents are later emptied into. A laborer using a bucket pours half of the needed water into the empty batch mixer and opens a slide gate, where by gravity alone dry pre-blended mortar empties into the batch mixer below. The quantity of dry material cannot be accurately measured because opening and closing of the slide gate doesn't always cause the material to flow. The material bridges and does not flow easily. The laborer then uses a shovel to bang on the steel silo with the slide gate open which often results in the discharge of too much material. When this happens the equipment (mixer) is strained, can break down and material is wasted. This labor intensive mixing cycle continues with more water added as needed. Specifications require a minimum of five minutes mixing time. If the mix is too wet, more dry materials must be added resulting in opening and closing of the slide gate.

Another problem with this approach is in the variation in size between the various grades of sand and cement particles which promotes segregation because the material is handled and dispensed numerous times. One reason for this is that as the material flows into a silo, the material beneath the inlet of the silo piles up at the so-called "angle of response" of the material. In this case, the larger particles often roll down the peak towards the sides of the silo, leaving the finer particles in the central region. Inhomogeneity can also occur when the silo is filled and the material is drawn off through an outlet at the bottom of the silo or bulk bag. The material flows from the region directly above the opening and thus is not representative of the material in the originally packed bulk bag. To avoid this problem, the pre-blended suppliers use too fine a sand that meets only the minimum sand grading specifications as described in ASTM C144 "*Specifications for Aggregates for Masonry Mortar*". A better product has a larger variation in sand gradation.

In addition to the problem of inconsistent mixture composition control, the silo approach also suffers from an unhealthy work environment because of the very dry sand falling on the laborer. Opening and closing of the overhead slide gate showers the laborer with very dry cementitious blended materials. The laborer ingests these sand and cement particles in the air he breathes which can cause silicosis and possibly cancer. This batch mixing operation cannot be made dust proof. The laborer's clothes are covered with dust which is brought home to possibly contaminate others. A batch mixer having a gasoline engine also endures further abuse by the intake of dust parties which can cause premature machine wear and necessitates more frequent replacement of air filters.

The mixing cycle continues and additional labor costs add up. The mixed contents are emptied into the mortar tub. The forklift operator now must stop other operations to exchange the full tub with an empty one, then carry the tub to the scaffold that may be hundreds of feet away from the mixing operation. This silo mixing operation is thus not portable, but rather is fixed in location. The 20,000 lb. weight of the forklift constantly traveling over dirt creates dust that slows the work. Another laborer at the top of the scaffold typically removes safety railings to allow the full tub to be placed on the scaffold. The forklift then moves over to pick up and lower an empty tub. The safety railings must then be reinstalled. The operation is not finished! The mortar must now be spread to the individual bricklayers by shoveling from the tub to the mortar boards so that the mortar is within easy reach of the individual bricklayers.

If the material is grout, labor costs to fill block is even a bigger factor because grout must be placed in buckets, then passed hand to hand, and poured into each individual block core by the bricklayers. This is wasteful because in addition to the time required to perform the needed operation, the bricklaying must stop in order to grout the block walls. In an attempt to address the high costs of this operation, a powered grout dispenser has been developed that must be filled at the mixing stage with all the accompanying labor intensive operations described for mixing mortar. This operation usually starts by elevating the batch mixer under the silo, charging the batch mixer with grout material, adding water and mixing for five minutes, then dumping the contents into the grout hopper. The wet mixture must then be transported to the work area where grout is dispensed from the holding hopper and directed to the block cores. The alternative to this is to fill the hopper with pre-mixed grout from a ready-mix cement truck, but this suffers from the problems of delivery truck availability and scheduling and additional costs.

Another type of mixing operation can be performed by a silo system using dry pre-blended material delivered to the job site by a bulk delivery truck that blows the material directly into the silo. The mixing can be performed by a continuous mixer installed under the silo. This approach is common in Europe and marketed as PFT, WAM. The mixed material is then typically pumped by a grout pump up to 200 ft. away where it is dispensed. The drawback in this approach is that additional equipment is required (pump and hoses), which must be cleaned and maintained. While this approach has been used in Europe for twenty years, it is not practical for masons in the United States who generally are capable of much higher levels of productivity and are less adapted for maintaining complicated machinery.

The various approaches discussed above each address specific problems encountered in the prior art, but also suffer from various limitations. There is currently no single mortar-blend delivery apparatus or method which combines the most advantageous features discussed above and allows for simple, efficient delivery of pre-mixed dry mortar-blended products. The present invention solves the problems and shortcomings of the prior art discussed above as described in the following paragraphs.

OBJECTS AND SUMMARY OF THE INVENTION

Accordingly, it is an object of the present invention to provide improved apparatus for mixing and delivering pre-blended granular mixtures onsite where the granular mixtures are to be used.

It is another object of the present invention to reduce the costs of mixing and dispensing cementitious compositions such as used by bricklayers at construction job sites.

A further object of the present invention is to mix at a job site pre-blended cementitious-based granular mixture with water to form a viscous solid-liquid suspension for use in masonry work in building construction.

Still another object of the present invention is to provide portable apparatus for mixing and dispensing pre-blended cementitious granular mixtures such as mortar and grout which can be easily moved to and positioned at the site of use.

A still further object of the present invention is to provide an environmentally clean, cost saving mixing and delivery apparatus for pre-blended granular mixtures which affords precise control of the proportions of the granular mixture components, requires fewer workers to operate, and is lightweight and compact to permit it to be easily positioned immediately adjacent to where the mixture is to be used.

The present invention contemplates a portable mixing/delivery apparatus for pre-blended granular mixtures which is user friendly, saves labor and delivers a quality mix. The inventive mixing/delivery apparatus takes the guess work out of the mixing process that heretofore allowed too much variation in mortar consistency. The inventive mixing/delivery apparatus is dust-proof, can be turned on or off as needed, and is adjustable in height for supporting a bulk bag of pre-blended materials. The bulk bag can be placed on top of the apparatus' steel framework by a forklift using a removable top frame and is safely held in place by the weight of the bulk bag. The discharge spout of the bulk bag empties into a receiving cylinder section that forms the intake of a hopper for receiving the dry pre-blended materials. The contents of the bag discharge into the dry end of a continuous mixer having a dynamic input mixing stage, an output dry-to-wet mixing stage, and a transition stage therebetween. An auger mixes the dry mortar that can segregate as it freely flows under gravity to the input stage and a horizontal metering screw moves the material forward in the continuous mixer. The metering screw extends into the tube-like transition stage. The entire assembly (bulk bag, support frame and continuous mixer) is portable and can be lifted to the desired height of a masonry scaffold by a forklift. Auxiliary hydraulic controls of the forklift with suitable hydraulic quick connects power the hydraulic motor of the continuous mixer. The inventive mixing/delivery apparatus allows the continuous mixer discharge tube end to rotate (90° either left or right) to facilitate material dispensing to either a mortar tub, or directly to mortar boards. Grout material can be poured directly into the hollow cores of cement blocks by extending the discharge tube with a flexible hose attached to the end of the tube. When the desired quantity is mixed, the apparatus is turned off, lowered and set on the ground, or moved where it can be reused at other work areas. The entire apparatus with optional gasoline, electric or hydraulic motor and controls can be set up on a heavy duty scaffold where it can be used as needed without lowering to the ground. A source of water is connected to the continuous mixer's mixing tube for forming a wetted mortar slurry. The auger and mixing tube combination is detachably connected to facilitate dismantling and clean up. A pair of closure plates are disposed adjacent to the aperture in the hopper for adjusting or shutting off the flow of mortar from the hopper to the transition tube.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements through the various figures, in which:

DETAILED DESCRIPTION OF THE PREFERRED EMBODIMENTS

Figure 1:
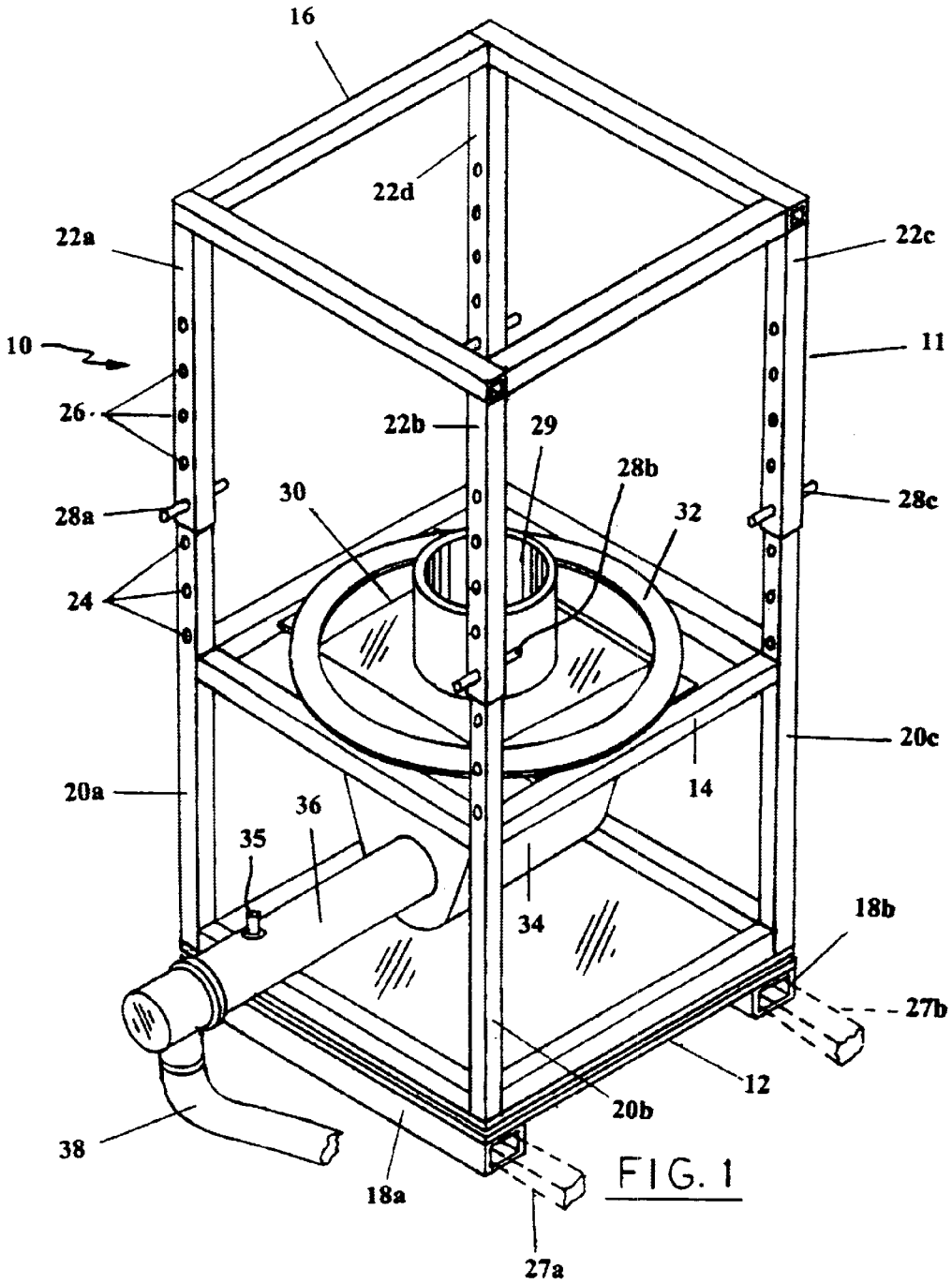
FIG. 1 is an upper perspective view of a portable mixing/delivery apparatus in accordance with the principles of the present invention.

Referring to FIG. 1, there is shown an upper perspective view of a portable mixing/delivery apparatus 10 in accordance with one embodiment of the present invention. The portable mixing/delivery apparatus 10 includes a generally upright support frame 11 comprised of lower frame members 12, intermediate frame members 14, and upper frame members 16. Each of the lower, intermediate and upper frame members 12, 14 and 16 is generally square, or rectangular, in shape and includes four elongated, generally linear tubes preferably comprised of a high-strength steel. The lower, intermediate and upper frame members 12, 14 and 16 are connected by means of the combination of first through fourth vertical frame members 20*a*–20*d* and fifth through eighth vertical frame members 22*a*–22*d*. Each of the first through fourth vertical frame members 20*a*–20*d* is connected in a telescoping manner to a respective one of the fifth through eighth vertical frame members 22*a*–22*d*. Each of the first through fourth vertical frame members 20*a*–20*d* is also provided with plural spaced, aligned apertures 26*a* along its length. Similarly, each of the fifth through eighth vertical frame members 22*a*–22*d* is provided with plural spaced, aligned apertures 24 along its length. The height of the support frame 11 may be adjusted by sliding the first through fourth vertical frame members 20*a*–20*d* up or down along a corresponding one of the fifth through eighth vertical frame members 22*a*–22*d*. Locking pins are inserted through aligned apertures in each pair of vertical frame members connected in a telescoping manner for maintaining the connected vertical frame members at a fixed length. Thus, locking pin 28*a* is inserted through aligned apertures in the first and fifth vertical frame members 20*a*, 22*a* for maintaining these frame members in fixed position relative to one another. Similarly, locking pin 28*b* is inserted through aligned apertures in the second and sixth vertical frame members 20*b*, 22*b*, while locking pin 28*c* is inserted through aligned apertures in the third and seventh vertical frame members 20*c*, 22*c*. It is in this manner that the height of the support frame 11 may be adjusted as desired to accommodate a range of sizes of a bulk bag attached to the support frame 11 which is not shown in FIG. 1, but which is described in detail below. The bulk bag contains dry pre-blended granular material which is converted to and dispensed as a mixed, wet granular material by the present invention.

Attached to the lower frame members 12 by conventional coupling means such as weldment or bolts (not shown for simplicity) are first and second base beams 18*a* and 18*b*. Each of the base beams 18*a*, 18*b* is tube-like in structure and is adapted to receive a respective fork 27*a* and 27*b* (shown in dotted line form) of a forklift. By means of the forklift, the portable mixing/delivery apparatus 10 may be easily lifted to an elevated location, such as a scaffold or other elevated support structure, adjacent to where the mixed, wet granular material produced by the portable mixing/delivery apparatus 10 is to be used.

Disposed on and supported by the intermediate frame members 14 of the support frame 11 is a mixer 30 for mixing dry pre-blended materials for producing and dispensing the mixed, wet granular material directly to the point of use, i.e., a mortar board, tub block core, etc. Mixer 30 includes an intake tube 29 disposed above and connected to a hopper 34. Dry pre-blended materials are deposited in hopper 34 via the intake tube 29 and are mixed by the mixer 30 and discharged from the hopper into a mixing tube 36. Water is added to the dry mixture in the mixing tube 36 via a water fitting 35. The mixed, wet granular material is discharged from the distal end of the mixing tube 36 into a flexible discharge tube 38 for discharge at the point of use. Mixer 30 is attached to a rotation ring 32, which, in turn, is positioned upon and supported by the intermediate frame members 14. Rotation ring 32 allows the mixer 30 to be rotated within the support frame 11 to facilitate discharge of the mixed, wet granular material at the point of use as described in greater detail below.

Figure 3:
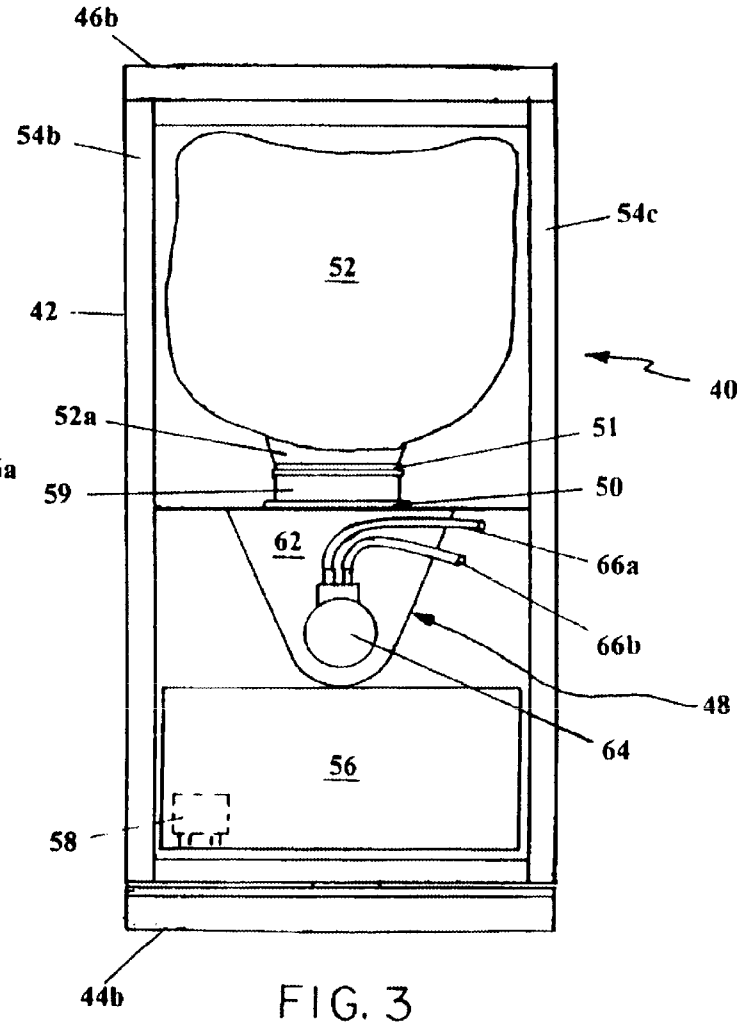
FIGS. 2 and 3 are side elevation views of another embodiment of a portable mixing/delivery apparatus in accordance with the present invention.
Figure 2:
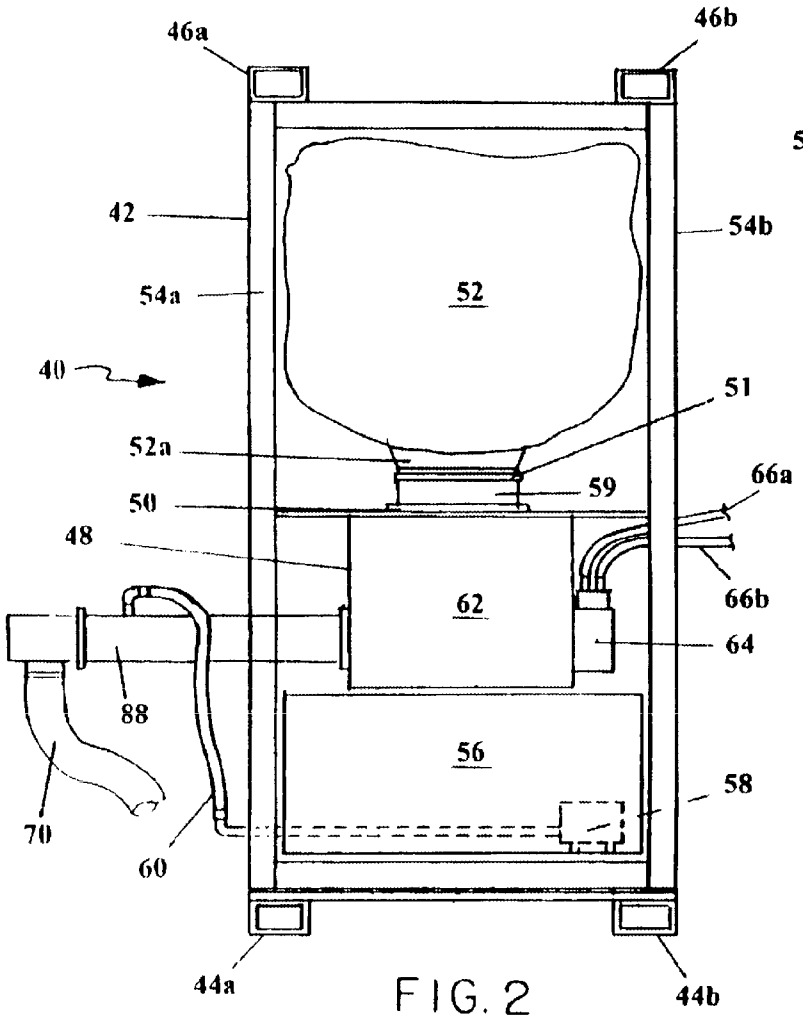

Referring to FIGS. 2 and 3, there are shown side elevation views of another embodiment of a portable mixing/delivery apparatus 40 in accordance with the present invention. As in the previously described embodiment, the portable mixing/delivery apparatus 40 includes a generally vertical support frame 42. Attached to a lower portion of the support frame 42 is a lower pair of forklift tubes 44*a* and 44*b*. Attached to an upper portion of the support frame are an upper pair of forklift tubes 46*a* and 46*b*. Each of the aforementioned forklift tubes is adapted to receive and engage a fork of a forklift to allow the portable mixing/delivery apparatus 40 to be lifted to an elevated position to facilitate discharge of the mixed, wet granular material at a point of use. As in the previously described embodiment, disposed within and attached to the support frame 42 is a mixing apparatus 48. Mixing apparatus 48 includes on an upper portion thereof an intake tube 59 which is attached to the discharge spout 52*a* of a bulk bag 52 by means of coupler ring 51. The bulk bag 52 contains dry pre-blended granular materials. A slide gate 50 disposed at the interface of the intake tube 59 and an upper portion of a dry material hopper 62 of the mixing apparatus 48 allows for controlling the flow of dry granular material from the bulk bag 52 into the hopper. The bulk bag 52 is supported by and suspended from an upper portion of the support frame 42 as described below. Support frame 42 is comprised of various elongated, generally linear structural members, as in the previously described embodiment, including four vertical support members with one each corner of the support frame. Three of these vertical support members are shown as elements 54*a*, 54*b* and 54*c*, with the fourth vertical support member not shown in the figures for simplicity. The mixing apparatus 48 includes an elongated, generally V-shaped hopper 62 to which is attached a motor 64 for mixing the dry pre-blended materials deposited in the hopper. Motor 64 may be electrical, gas driven, hydraulic or other type of drive mechanism for mixing and displacing the dry pre-blended granular materials deposited in the hopper 62. In the example shown in FIGS. 2 and 3, first and second hydraulic lines 66*a* and 66*b* are connected to a hydraulic motor 64 for rotationally displacing the motor and mixing the dry pre-blended materials within the hopper 62. An auger/agitator arrangement within the hopper 62 rotationally driven by the hydraulic motor 64 displaces the dry pre-blended materials out of the hopper into a mixing tube 68 where the material is further mixed, wetted and then discharged into a flexible discharge tube 70. The distal end of the flexible discharge tube 70 is preferably positioned at the point of use of the discharged material.

Disposed in a lower portion of the support frame 42 is a water tank 56 including a water pump 58 therein. The water pump 58 is connected to the mixing tube 68 of the mixing apparatus 48 by means of a water line 60. By means of pump 58 and water line 60, water is injected into the dry pre-blended material displaced from the hopper 62 toward the distal end of the mixing tube 68. The dry pre-blended materials are converted with the addition of water to a mixed, wet granular material which is discharged from the distal end of the flexible discharge tube 70 for use at the work site.

Figure 4:
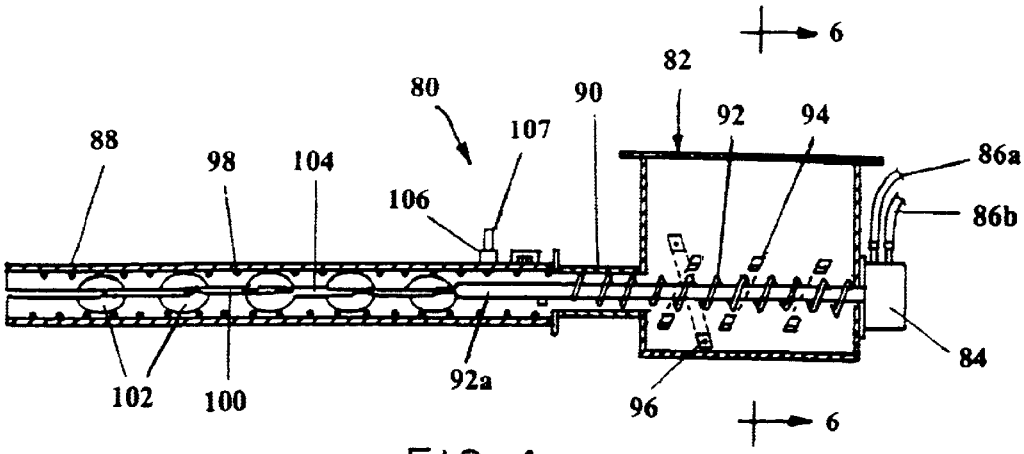
FIG. 4 is a vertical sectional view of one embodiment of a mixing apparatus for use in the portable mixing/delivery apparatus of the present invention.
Figure 5:
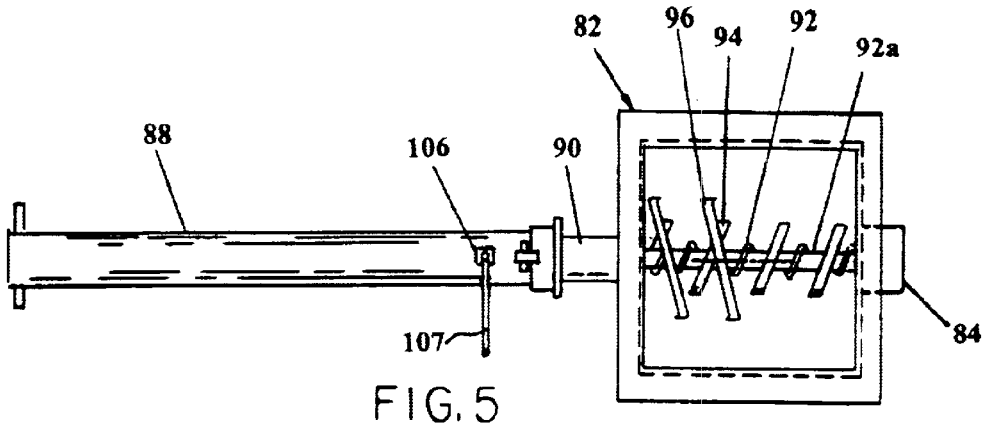
FIG. 5 is a top plan view of the mixing apparatus shown in FIG. 4.
Figure 6:
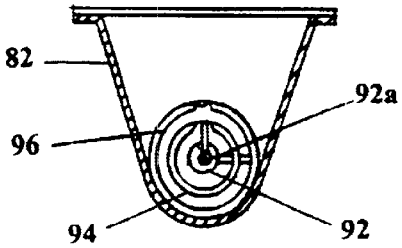
FIG. 6 is a sectional view of the mixing apparatus shown in FIG. 4 taken along site line 6—6 therein.

Referring to FIGS. 4 and 5, there are respectively shown lateral sectional and top plan views of one embodiment of a continuous mixing apparatus 80 for use in the portable mixing/delivery apparatus of the present invention. A sectional view of the mixing apparatus 80 illustrated in FIG. 4 and taken along site line 6—6 therein is shown in FIG. 6. It should be noted that while a specific mixing apparatus 80 is shown in FIGS. 4–6 for use in the present invention, various mixing apparatus arrangements which provide for the continuous mixing of dry pre-blended granular materials, the wetting of these materials, and the formation and discharge of mixed, wet granular material could be used equally as well in the present invention. Therefore, the description of the mixing apparatus 80 set forth herein is not to be taken as a limitation of the present invention, but rather merely as a description of one embodiment of a mixing apparatus which could be used in the present invention. The mixing apparatus 80 disclosed herein is the subject of U.S. Pat. No. 6,123,445, entitled "Dual Stage Continuous Mixing Apparatus", which issued on Sep. 26, 2000, in the name of the present applicant.

Mixing apparatus 80 includes a dry material hopper 82 open at the top, which preferably includes a cylindrical intake tube for the deposit of granular materials in the hopper. The intake tube, which is described in the embodiments shown in FIGS. 1–3, is not shown in FIGS. 4–6 and is not described in terms of the embodiment shown in these latter figures for the sake of simplicity. Disposed within dry material hopper 82 is a metering screw 92 including a linear, elongated shaft 92*a*. One end of the shaft 92*a* is connected to a hydraulic motor 84 to which hydraulic fluid under pressure is provided via first and second hydraulic lines 86*a* and 86*b*. Also attached to the metering screw's shaft 92*a* is an inner helical agitator 94. The combination of metering screw 92 and inner helical agitator 94 mix the dry pre-blended materials deposited within the dry material hopper 82 and displace the thus mixed material leftward as viewed in FIGS. 4 and 5 toward a transition tube 90 attached to and extending from a lateral wall of the dry material hopper 82. Metering screw 92 is aligned with and extends through the transition tube 90 through which the dry pre-blended materials are directed after they had been mixed within the dry material hopper 82. Also attached to and disposed about the metering screw's shaft 92 is an outer agitator 96. The function of the inner helical agitator 94 is to promote a right-to-left flow as viewed in FIGS. 4 and 5 of granular material within the dry material hopper 82 when the metering screw 92 is rotating. The inner helical agitator 94 has the same angular direction as metering screw 92. The metering screw continually moves granular material in a right-to-left direction, such that there is a tendency for material in the dry material hopper 82 proximate to the exit opening leading to the hopper's transition tube 90 to be depleted to an undesirable extent. Granular material surrounding the metering screw has to flow into the space formed by the flutes of the screw in order for the screw to deliver a relatively constant quantity of material to the transition tube 90. The inner helical agitator 94 produces a leftward flow of granular material toward the exit wall of the dry material hopper 82. The inner helical agitator 94 also achieves an anti-cavitation effect, to maintain the metering screw 92 relatively full of dry, pre-blended material and effective for granule pumping purposes.

The function of the outer agitator 96 is to promote a left-to-right flow of material within the dry material hopper 82 especially when closure plates (not shown for simplicity) disposed adjacent the inlet of the transition tube 90 are in the closed position. The outer agitator 96 has a helix direction that is opposite to the angular direction of the helical flutes of the metering screw 92 and is also opposite to the direction of the inner helical agitator 94. While the metering screw 92 and the inner helical agitator 94 tend to move the granular material in a right-to-left direction, the outer agitator 96 tends to move the granular material in a left-to-right direction within the dry material hopper 82. Metering screw 92 extends into and through the transition tube 90' attached to a lateral wall of the dry material hopper 82.

The dry pre-blended granular material passes through the transition tube 90 into a water mixing tube 88. Mixing tube 88 is provided with a water fitting 106 which is connected to a water hose 107. Pressurized water flows from hose 107 into the mixing tube 88, such that the water is mixed with the dry pre-blended granular material being transported through the mixing tube. Water flow control is provided by conventional volumetric flow control means, including an on-off valve, which is not shown in the figures for simplicity. Mixing tube 88 has a larger diameter than the transition tube 90 to promote a satisfactory mixing action.

A screw-type auger 98 is provided within the mixing tube 88 for mixing the water with the dry pre-blended granular material, and for transporting the mixture along the mixing tube 88 in a right-to-left direction. Auger 98 is shown as an elongated cylindrical rod formed into a coil configuration so that the outer surface of each coil convolution has a sliding fit on the inner surface of the mixing tube 88, with the tube supporting the auger weight. Auger 98 is connected to and powered by the metering screw shaft 92*a*. There is disposed within and along the length of the mixing tube 88 a baffle mechanism 104 comprised of an axial rod 100 and plural-spaced sets of baffle plates 102. Axial rod 100 is connected to and rotates with the shaft 92*a* of the metering screw 92. The baffle plates are spaced along the length of the axial rod, with the baffle plates arranged in pairs such that each baffle plate is acutely angled relative to the axial rod 100 at an angle of approximately 40°. Each baffle plate 102 has an inner edge extending through the axis of the axial rod 100 and an arcuate outer edge adapted to slidably rest on an inner edge surface of the auger 98 coil. Thus, the baffle mechanism is supported (partially) by auger 98, and auger 98 is supported by mixing tube 88. The baffle mechanism 104 is non-rotatable, whereas the auger 98 is rotatable via the combination of the rotating metering screw shaft 92*a* and axial rod 100.

Figure 8:
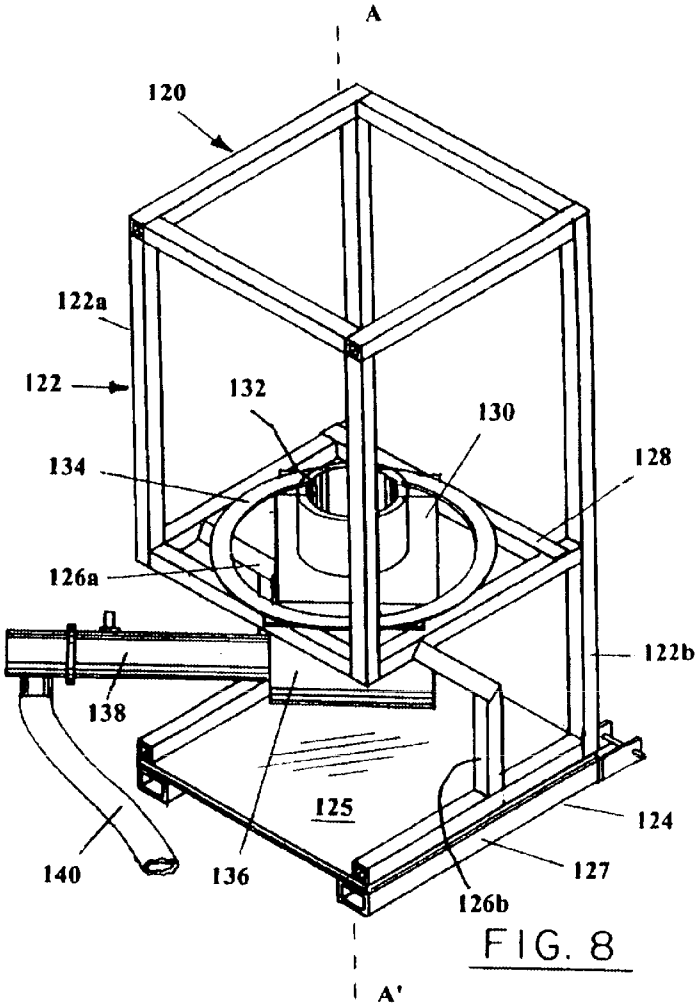
FIGS. 7 and 8 are upper perspective views of another embodiment of a portable mixing/delivery apparatus in accordance with the present invention showing the mixer in two different positions for facilitating dispensing of the mixed, wet granular material directly to the point of use at a work site.
Figure 7:
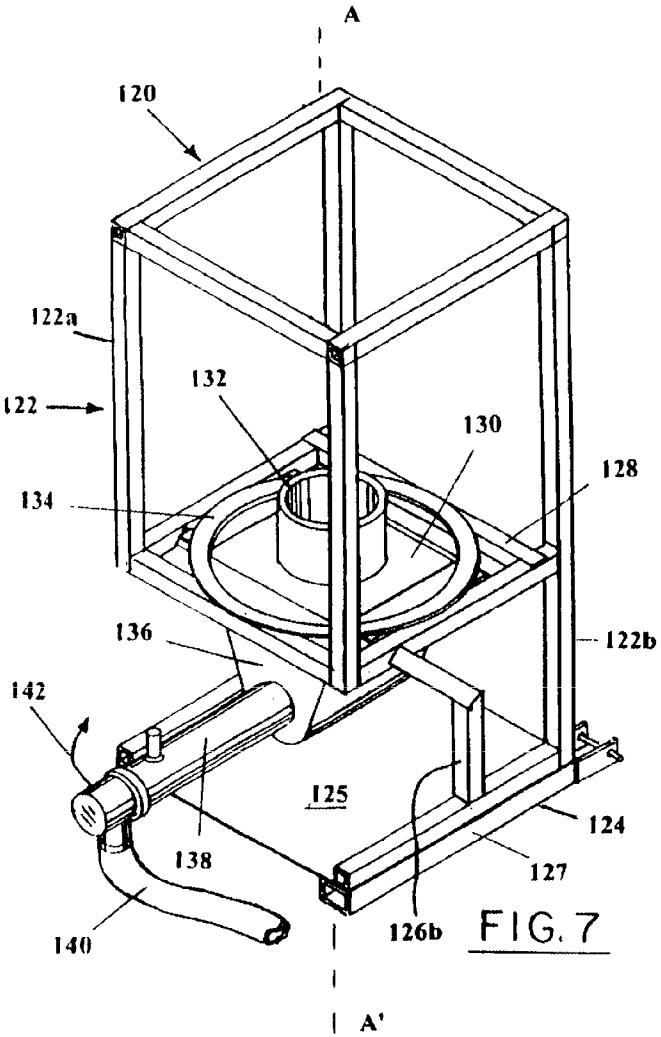

Referring to FIGS. 7 and 8, there are shown upper perspective views of another embodiment of a portable mixing/delivery apparatus 120 in accordance with the principles of the present invention. FIG. 8 shows the position of a mixer 130 after it has been rotationally displaced in the direction of arrow 142 from its position shown in FIG. 7. As in the previously described embodiments, the portable mixing/delivery apparatus 120 includes a support frame 122 comprised of an upper frame 122*a* and a lower frame 122*b*.

The lower frame 122*b* includes a base 124 comprised of a flat bottom plate 125 and a pair of spaced forklift tubes mounted to opposed lateral edges of the bottom plate, where one of the forklift tubes is shown as element 127 in the figures.

The support frame 122 further includes a generally square, or rectangular, intermediate frame 128 which provides support for mixer 130. As described above, mixer 130 may be conventional in design and operation and in the embodiment shown in FIGS. 7 and 8 includes an upper intake tube 132 for receiving dry pre-blended granular material for deposit in a hopper 136 of the mixer. Attached to and extending from the mixer's hopper 136 is a mixing tube 138 through which the pre-blended granular material is displaced and within which the material is mixed with water for discharge into a flexible discharge tube 140 attached to the distal end of the mixing tube.

In accordance with the embodiment of the invention shown in FIGS. 7 and 8, a rotation ring 134 is connected to the mixer's hopper 136 and positioned upon the generally linear, elongated structural members forming the intermediate frame 128. Rotation ring 134 permits the mixer 130 to be angularly displaced about a vertical axis A–A' (shown in dotted line form) aligned generally with the support frame 122 and passing through the mixer's intake tube 132 and hopper 136. Lower frame 122*b* includes first and second angled support struts 126*a* and 126*b* disposed between and connected to the intermediate frame 128 and base 124. The first and second angled support struts 126*a* and 126*b* are configured and positioned so as to permit the mixer 130 to be rotated over an angular displacement of approximately 180° about the aforementioned vertical axis A–A' as shown by direction arrow 142 in FIG. 7. This arrangement substantially increases the flexibility of the portable mixing/delivery apparatus 120 to deliver the mixed, wet granular material directly to the point of use.

Figure 10:
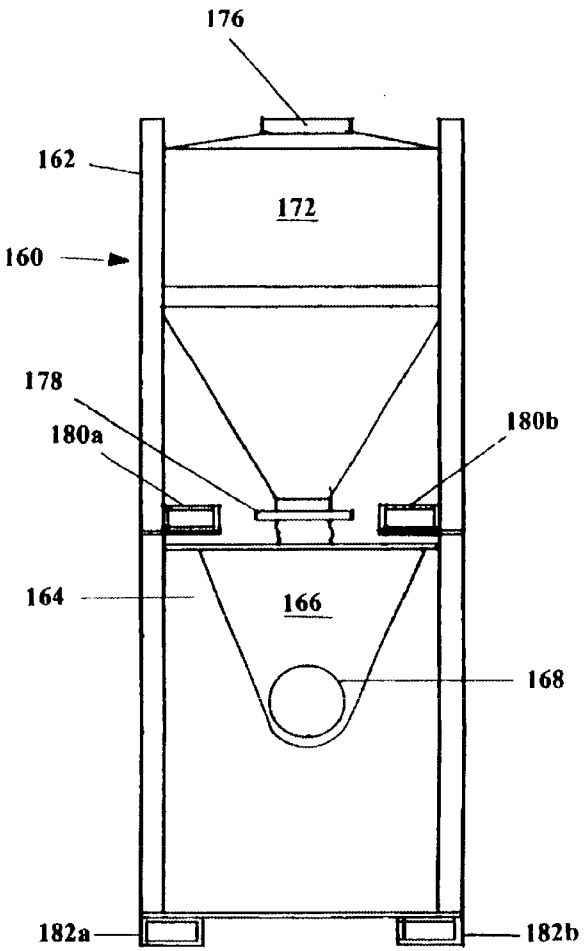
FIGS. 9 and 10 are side elevation views of another embodiment of a portable/mixing delivery apparatus in accordance with the principles of the present invention which includes the hopper for storing the dry pre-blended materials prior to mixing, wetting and dispensing to the point of use.
Figure 9:
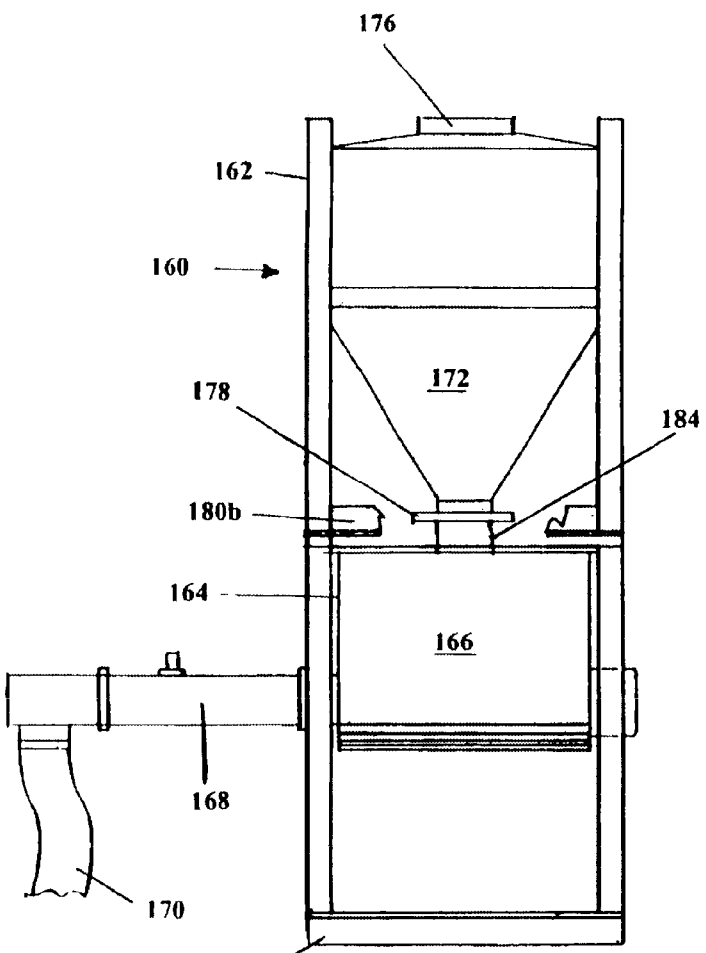

Referring to FIGS. 9 and 10, there are shown side elevation views of yet another embodiment of a portable mixing/delivery apparatus 160 in accordance with the present invention. As in the previously described embodiments, the embodiment of the portable mixing/delivery apparatus 160 shown in FIGS. 9 and 10 includes a generally vertical support frame 162. Attached to a lower portion of the support frame 162 are a pair of lower forklift tubes 182*a* and 182*b*. Similarly, attached to an intermediate portion of the support frame 162 are a pair of upper forklift tubes 180*a* and 180*b*. A portion of one of the upper forklift tubes 180*b* is partially cut away in FIG. 9 to show details of an upper portion of a mixer 164 and a lower portion of a bulk hopper 172 which are attached to the support frame 162. Mixer 164 includes a dry granular material hopper 166 having extending therefrom a mixing tube 168. Attached to a distal end of the mixing tube is a flexible discharge tube 170 through which the mixed, wet granular material provided by the mixer 164 is discharged to the point of use at a work site.

In the embodiment shown in FIGS. 9 and 10, the bulk hopper 172 containing a mixture of dry pre-blended granular materials is disposed above the mixer 166 and is securely attached to the support frame 162 by conventional means such as weldments or nut and bolt connections (which are not shown in the figures for simplicity). A coupling ring 178 connects a lower discharge end of the bulk hopper 172 to a flexible coupler 184 with a removable lid to permit the mixer's dry granular material hopper 166 to be filled by hand as an alternative. A refill lid 176 on the bulk bag 174 allows for re-filling of the bulk bag when empty. Bulk hopper 172 is preferably comprised of a lightweight, high strength material such as polyethylene.

Figure 11:
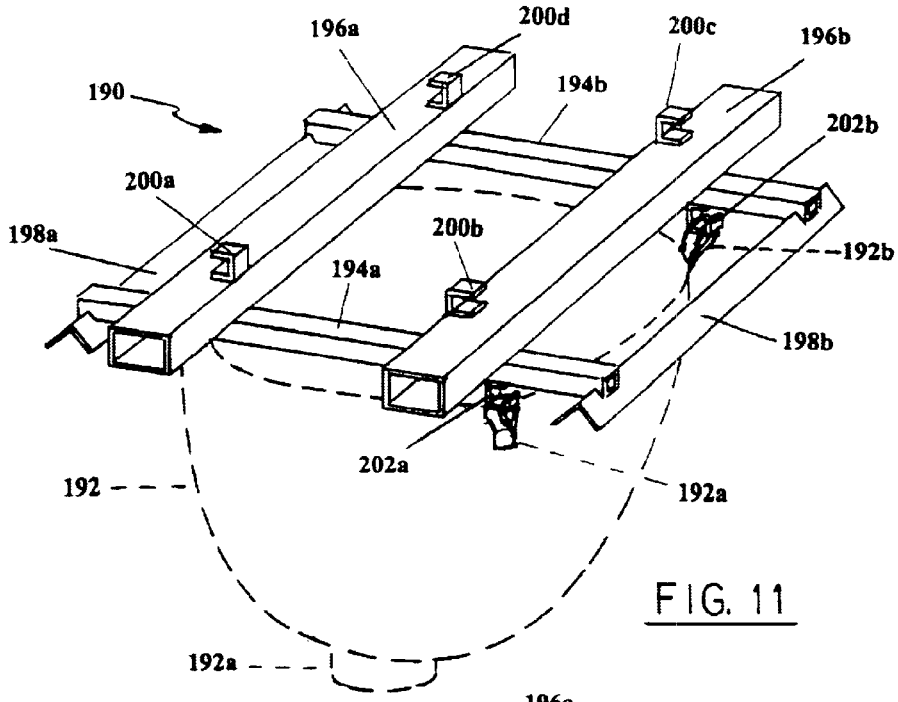
FIG. 11 is an upper perspective view of a removable top frame for use in supporting a bulk bag containing dry pre-blended materials for use in the portable mixing/delivery apparatus of the present invention.
Figure 12:
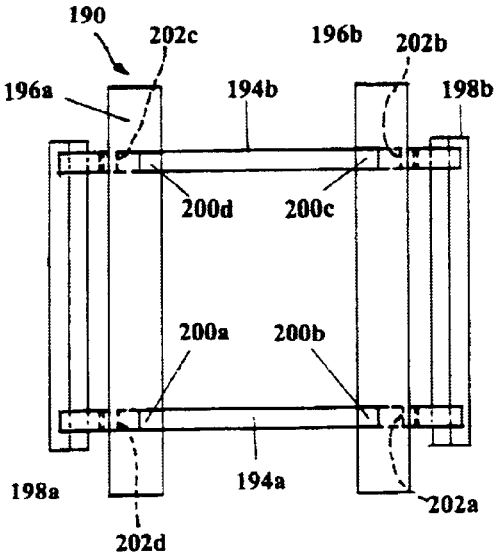
FIG. 12 is a top plan view of the top frame structure shown in FIG. 11.
Figure 13:
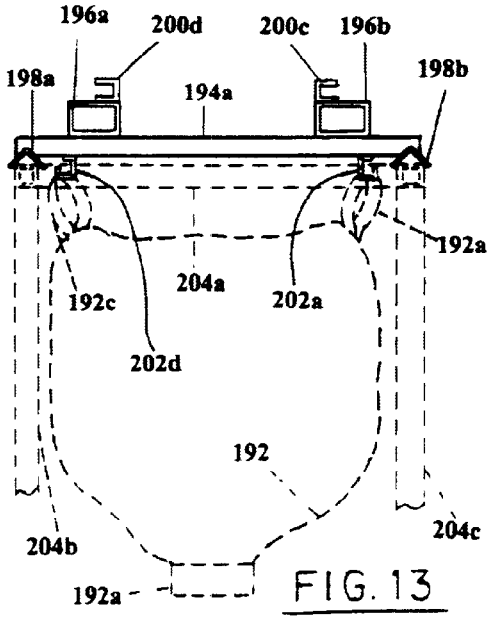
FIG. 13 is a side elevation view of the top frame structure shown in FIGS. 11 and 12 illustrating the manner in which a bulk bag is attached and supported by the top frame as well as the manner in which the top frame is positioned on a support frame of the portable mixing/delivery apparatus of the present invention.

Referring to FIGS. 11 and 12, there are shown respectively upper perspective and top plan views of a removable top frame 190 for use in the support frame of the portable mixing/delivery apparatus of the present invention. A side elevation view of the top frame 190 showing the manner in which it is positioned upon and supported by a support frame is shown in FIG. 13. The removable top frame 190, which is in the form of a tubular steel rack, provides support for a bulk bag 192 (shown in the figures in dotted line form) which contains the dry pre-blended granular material and includes a discharge spout 192*a* on a lower portion thereof. Securely attached to an upper portion of the bulk bag 192 are plural support loops, where three of the support loops are shown as elements 192*a*, 192*b* and 192*c* in the various figures.

Top frame 190 includes first and second forklift tubes 196*a* and 196*b*, each adapted to receive and engage a respective fork of a forklift for loading the bulk bag 192 onto the support frame of the portable mixing/delivery apparatus of the present invention. The first and second forklift tubes 196*a*, 196*b* are connected by first and second cross members 194*a* and 194*b*. First and second support members 188*a* and 198*b* are securely attached to respective adjacent ends of the first and second cross members 194*a*, 194*b*. The aforementioned cross members, forklift tubes and support members may be connected together by conventional means such as weldments or nut and bolt combinations, which are not shown in the figures for simplicity. As shown in FIG. 13, the first and second support members 198*a*, 198*b* of the top frame 190 are adapted for positioning upon respective upper portions of the portable mixing/delivery apparatus support frame, a portion of which is shown in dotted line form as including a horizontal support frame member 204*a* and vertical support frame members 204*b* and 204*c*. In this manner, the top frame 190 is securely and stably positioned upon the support frame, while easily removed such as by a forklift from the support frame. The height of the top frame 190 resting upon the upper portion of the support frame may be adjusted to accommodate a range of bulk bag sizes as shown in FIG. 1 and as described above.

In accordance with this aspect of the present invention, plural hooks are attached to the top frame 190 for securely suspending the bulk bag 192 containing dry pre-blended granular materials for discharge into the mixer of the portable mixing/delivery apparatus. Thus, first through fourth lower hooks 202*a*–202*d* are each attached to and suspended from one of the first and second cross members 194*a*, 194*b* of the top frame 190. Similarly, first through fourth upper hooks 200*a* –200*d* are each attached to one of the first or second forklift tubes 196*a*, 196*b*. Thus, as shown in FIGS. 11 and 13, first, second and third support loops 192*a*, 192*b* and 192*c* of the bulk bag 192 respectively engage and are suspended from lower hooks 202*d*, 202*a* and 202*b*. A fourth support loop and hook combination is used to suspend a fourth corner of the bulk bag 192 from the top frame 190, although this is not shown in the figures for simplicity.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation.

The actual scope of the invention is intended to be defined in the following claims when viewed in their proper perspective based on the prior art.

I claim:

1. A portable mixing/delivery apparatus for dispensing mixed, wet granular material directly to a point of use for said material at a job site, said apparatus comprising:

a support frame;

a container holding dry pre-blended granular material attached to said support frame;

a source of liquid;

a continuous mixer coupled to said source of liquid and attached to said support frame for receiving said dry pre-blended granular material from said container and converting said dry pre-blended granular material to a mixed, wet granular material for continuous discharge directly at the point of use; and lift means attached to said support frame for receiving a lift mechanism for transporting the apparatus to the point of use.

2. The apparatus of claim 1 wherein said lift means includes plural receptacles for receiving and engaging the lift mechanism.

3. The apparatus of claim 2 wherein said lift mechanism is a forklift having a pair of forks, and wherein said lift means includes first and second tubular structural members each adapted to receive and engage a respective fork.

4. The apparatus of claim 3 wherein each of said tubular structural members is generally linear, elongated and hollow in shape.

5. The apparatus of claim 1 wherein said container is a bulk bag or a hopper.

6. The apparatus of claim of 5 wherein said hopper is comprised of a high strength, lightweight plastic.

7. The apparatus of claim 6 wherein said high strength, lightweight plastic is polyethylene.

8. The apparatus of claim 1 wherein said container is a bulk bag or a bulk hopper and said continuous mixer includes a mixer hopper and an intake tube attached to said mixer hopper and wherein a lower portion of said bulk bag or bulk hopper is attached to said intake tube for delivering dry pre-blended granular material to said mixer hopper.

9. The apparatus of claim 1 wherein said continuous mixer includes a hopper for receiving dry pre-blended granular material, a mixing tube connected to said hopper, and mixing/displacement means for mixing the dry pre-blended granular material in said hopper and displacing the material into and through said mixing tube.

10. The apparatus of claim 9 wherein said source of liquid is connected to said mixing tube for wetting the dry pre-blended granular material.

11. The apparatus of claim 10 further comprising a flexible discharge tube connected to said mixing tube for dispensing the mixed, wet granular material to the point of use.

12. The apparatus of claim 1 wherein said container is a bulk bag, and wherein said support frame is adjustable in height to accommodate a range of bulk bag sizes.

13. The apparatus of claim 1 wherein said support frame includes a removable top frame connected to and supporting a bulk bag containing dry pre-blended granular material for deposit in said continuous mixer.

14. The apparatus of claim 13 wherein said bulk bag includes plural loops and said removable top frame includes plural hooks each adapted to engage a respective loop for supporting said bulk bag in a suspended position.

15. The apparatus of claim 14 wherein said removable top frame includes plural connections for receiving and engaging a lift mechanism for placing said top frame on or removing said top frame from said support frame.

16. The apparatus of claim 15 wherein said lift mechanism is a forklift having a pair of forks and said connections include first and second tubular structural members each adapted to receive and engage a respective fork.

17. The apparatus of claim 16 wherein each of said tubular structural members is generally linear, elongated and hollow in shape.

18. A portable mixing/delivery apparatus for dispensing mixed, wet granular material directly to a point of use for said material at a job site, said apparatus comprising:

a support frame;

a container holding dry pre-blended granular material attached to said support frame;

a source of liquid;

a continuous mixer coupled to said source of liquid and attached to said support frame for receiving said dry pre-blended granular material from said container and converting said dry pre-blended granular material to a mixed, wet granular material for discharge directly at the point of use;

lift means attached to said support frame for receiving a lift mechanism for transporting the apparatus to the point of use; and a movable mounting arrangement attaching said continuous mixer to said support frame to facilitate discharge of the mixed, wet granular material directly to the point of use.

19. The apparatus of claim 18 wherein said movable mounting arrangement includes a rotation ring for allowing pivoting displacement of said continuous mixer in said support frame.

20. The apparatus of claim 19 wherein said continuous mixer is pivotally displaceable over at least 180°.

* * * * *